US006938656B2

(12) United States Patent
Plouffe et al.

(10) Patent No.: US 6,938,656 B2
(45) Date of Patent: Sep. 6, 2005

(54) ADJUSTABLE WOOD PROCESSING DEVICE AND METHOD OF ADJUSTING THE SAME

(75) Inventors: Christian Plouffe, Laval (CA); Ian G. Zinniger, Ste-Therese (CA)

(73) Assignee: Iggesund Tools AB, Iggesund (SE)

( * ) Notice: Subject to any disclaimer, the term of this patent is extended or adjusted under 35 U.S.C. 154(b) by 89 days.

(21) Appl. No.: 10/261,470

(22) Filed: Oct. 2, 2002

(65) Prior Publication Data

US 2003/0070728 A1 Apr. 17, 2003

(51) Int. Cl.[7] ..... B27C 5/00; B26D 1/143
(52) U.S. Cl. ..... 144/220; 407/36
(58) Field of Search ..... 144/218, 220, 144/221, 235, 162.1, 172, 174, 176, 373; 407/36, 44

(56) References Cited

U.S. PATENT DOCUMENTS

| | | | | |
|---|---|---|---|---|
| 49,161 A | | 8/1865 | Shannon | |
| 269,315 A | | 12/1882 | Orum | |
| 743,374 A | | 11/1903 | Bresman | |
| 3,817,305 A | | 6/1974 | Ferguson et al. | 144/231 |
| 3,842,873 A | | 10/1974 | Valo | 144/218 |
| 4,480,667 A | * | 11/1984 | Vaittinen et al. | 144/176 X |
| 5,511,597 A | | 4/1996 | Shantie et al. | 144/220 |
| 5,575,320 A | | 11/1996 | Brisson | 144/220 |
| 5,617,908 A | | 4/1997 | Toogood | 144/218 |
| 5,662,436 A | * | 9/1997 | Bishop | 407/35 |
| 5,709,255 A | | 1/1998 | Toogood | 144/220 |
| 5,816,301 A | | 10/1998 | Stager | 144/228 |
| 5,857,508 A | * | 1/1999 | Jonkka | 144/363 |
| 6,164,352 A | | 12/2000 | Simonsen | 144/373 |
| 6,227,267 B1 | | 5/2001 | Mitchel et al. | 144/220 |

FOREIGN PATENT DOCUMENTS

SE 8902290-9 7/1991

OTHER PUBLICATIONS

6–112961, Admitted Prior Art Drawing.

* cited by examiner

*Primary Examiner*—Derris H. Banks
*Assistant Examiner*—Shelley Self
(74) *Attorney, Agent, or Firm*—Fitzpatrick, Cella, Harper & Scinto

(57) ABSTRACT

A wood processing device having a spinning wood processing head having one or more spaced apart knives mounted on said spinning head for processing wood. The knives, upon contacting said wood, form a curved cut surface in said wood being processed. At least one limit surface is adjustably mounted between said one or more knives on said spinning head, said limit surface being sized and shaped to limit abnormal movement of said wood during processing. An adjustor for adjusting a position of said limit surface is provided to permit said limit surface to limit abnormal movement of said wood over a range of operating conditions. In a preferred embodiment the limiter is curved. A method of adjusting a wood processing head is also disclosed.

65 Claims, 12 Drawing Sheets

ADJUSTABLE WOOD PROCESSING DEVICE AND METHOD OF ADJUSTING THE SAME

BACKGROUND OF THE INVENTION

Field of the Invention

This invention relates generally to the forest industry, and more specifically, to wood processing machines having rotating heads used in sawmills. Within this industry, various sizes and shapes of chipping, cutting and planing devices having knives are used to make, for example, lumber from logs and to produce wood chips, wafers, or flakes. The wood chips, wafers, or flakes may then be used in the formation of pulp, waferboard, oriented-strand board or other products.

Rotating chipping, planing and cutting heads employed in sawmill wood processing machines generally fall into two categories; cylindrical and conical. Cylindrical heads typically have a plurality of cutting knives mounted on the outer periphery of a cylindrical head. The knives are mounted parallel to the axis of rotation and form a cutting cylinder as the head rotates. Conical heads are characterized in that the knife blades are mounted to a rotating head to form a truncated cone when the head spins. Typically present at one end are finishing knives or circular saws which are mounted perpendicular to the cone axis. In machines having either cylindrical or conical heads, wood to be processed is advanced by a feeding mechanism into the path of the knives where it is planed, chipped, cut or the like. Examples of such devices, which are quite widespread in the industry, are illustrated in the following U.S. patents:

| | | |
|---|---|---|
| Toogood | U.S Pat. No. 5,709,255 | Jan. 20, 1998 |
| Toogood | U.S Pat. No. 5,617,908 | Apr. 8, 1997 |
| Shantie et al. | U.S Pat. No. 5,511,597 | Apr. 30, 1996 |
| Orum | U.S Pat. No. 269,315 | Dec. 19, 1882 |
| Shannon | U.S Pat. No. 49,161 | Aug. 1, 1865. |

In general, the purpose of such chipping, planing, and cutting heads is to produce a predetermined finish on the wood being processed and/or to produce chips, wafers, or flakes of a predetermined size. Both results require a precise positioning of the wood being processed relative to the knife edge working the wood. Specifically, three main variables determine the size of any wood particles produced. The first is the rotational speed of the head, the second is the linear speed at which the wood is advanced into the path of the knives by the feed mechanism of the machine, and the third is the number of knives on the head. For a given head with a fixed number of knives, if the speed of the head is increased at the same feed rate, smaller sized chips, wafers, or flakes will be produced because the wood will advance less for each cut. If the speed of the feed mechanism is increased for the same head speed, larger particles will be produced because the wood will advance more during each pass of the knife. To produce wood chips, wafers, or flakes of a consistent and predetermined size thus requires uniform head and feed speeds. Similarly, variations in head or feed speed can change the quality and accuracy of the finish of the wood being processed.

In some machines, particularly those with chipping heads, problems arise from the extreme cutting forces applied by the knives during processing. This can cause irregular movement of the wood, which in turn, results in uneven sized wood chips and a reduced quality of cut lumber. Although such irregular movement is normally limited by the grip of the feed mechanism on the wood or other guide mechanisms, the machine often includes a secondary means to limit any such irregular movement to a maximum predetermined and acceptable amount. This secondary means is typically in the form of a limiting surface on the wood processing head against which the wood can abut to restrict abnormal movement. Often, the component on which this surface is mounted is referred to as a limiter.

In most such machines, such limiting surfaces are incorporated into the periphery of the head so as to be able to abut against the cut surfaces of the wood being processed. Such limiting surfaces are formed so as to avoid contact with the wood under normal machine operation to prevent detrimental jostling of the wood being processed and minimize wear. However should excessive abnormal movement occur, the wood being processed abuts the surface which prevents the wood from advancing further during the knife strike or from being drawn into the cutting head. These surfaces are subject to significant forces and are traditionally formed integral with the head and so cannot be replaced or changed. An example of a cylindrical chipping head with an integral limiter is shown in U.S. Pat. No. 2,817,305 to I. W. Ferguson and J. W. McNaughton.

Like cylindrical designs, conical chipping heads also include limiting surfaces as an integral part of the head. However some designs make use of replaceable fixed components, sometimes referred to as wear plates, rather than incorporating the limiting surfaces as a permanent part of the head. An example of such a conical chipping head may be found in U.S. Pat. No. 5,511,597 to Key Knife Inc. These chipping heads are provided with replaceable, but fixed, wear plates against which the wood being processed may abut during chipping. As per the teachings of this patent, this affords the advantage that the wear plates can be replaced in the event that excessive wear occurs on the limiting surfaces.

At present, wear plates, or limiters, whether integral with the head or affixed as replaceable components, are formed with a limiting surface, or set of surfaces, designed for a specific set of operating conditions which include wood feed rate, head speed and cutting location. Any variation in chip size or cutting location (due to a size change in the wood being fed into the head) will influence the shape of the limiting surface required to maintain clearance with the normal wood advancement while effectively limiting abnormal wood movement. Often, small changes in operating conditions can require a different limiter if acceptable performance is to be achieved. Thus, if an operator decides to change any wood processing settings to improve speed, quality, or to suit the specific type or size of wood being processed, the manufacturer may be required to service the machine and, if possible, replace the existing limiters with ones more appropriately sized and shaped to the new shape of limiting surface required to limit abnormal wood movement for the new operating conditions.

However, in practice, the machine manufacturers are unable to anticipate all variations in operating conditions. Thus, limiters are only available with surfaces having predetermined increments of change of shape (which increments and shape are set by the manufacturer and not the operator). These set increments may at best only approximate what the operator needs. This can result in limiters being mismatched to operating conditions yielding limiting surfaces which can reduce-the effectiveness of the machine or worse, interfere with its normal and proper operation.

Often, the operator is unable to make corrections very easily as significant waiting periods are involved to allow for new limiters to be manufactured and delivered. For machines with limiting surfaces formed integral with the head, no flexibility exists to adjust for different operating conditions whatsoever.

According to a recent U.S. Pat. No. 6,164,352 to Key Knife Inc., a wood surfacing method and apparatus which includes a projecting surface on a cutting head located behind the knife can be formed. The projecting surface is adapted to make contact with the wood with a force that is substantially constant as the wood is fed to the machine. The constant force is achieved, according to the teachings of this patent, by having the surface recede radially inward from the cutting circle of the knives at a rate that corresponds to the speed of the relative linear translation of the wood relative to the angular position of the cutting head.

The advantage claimed with such an apparatus is that a constant supporting force can be developed from the intentional contact of a projecting surface with the wood being processed such that it may resist the cutting forces developed by the knives in order that an increased quality of surface be produced. However, for a constant supporting force to be achieved, the component of the relative movement of the wood in a direction that is radial to the head must coincide exactly with the radial recession of the projecting surface. This can only occur for linear translation that occurs at a specific offset distance from the head centre. Should this offset distance be altered as a result in a change in wood dimensions, the projecting surface would either lose contact with the wood completely or hinder normal wood advancement. While offering an improved surfacing method for wood processing devices where such ideal, stable, and fixed operating conditions occur, this invention does not offer a practical and effective solution for the control of abnormal wood movement across a range of operating conditions.

SUMMARY OF THE INVENTION

What is desired is a method and apparatus for varying the limiting surfaces on the cutting heads to accommodate variations in operating conditions, such as feed rate and head speed, to allow for a flexible and effective means to limit abnormal wood movement. Most preferably the method and apparatus should be variable across a range of machine settings and operating conditions including changes in wood size, chip size, wood species, and wood temperature. In addition, most preferably the adjustment can be made to existing components, by the operator, without requiring any new parts or servicing from the manufacturer. Such a device should be reliable and secure against the extreme forces generated during contact with the wood when limiting abnormal wood movement. Further, such a device should be simple to adjust, without the need for special tools by the operator, and without requiring the de-mounting, removal and replacement of various fixed components. Moreover, the apparatus should be constructed so as to be adaptable to the range of cylindrical and conical head sizes in use in the industry.

According to the present invention an adjustable limiting surface can be provided which can limit the abnormal movement of wood being processed during operation. In one embodiment, the limiting surface is releasably mounted to the cutting head in a way that allows the limiting surface to be released, pivoted about a pivot-axis to a new position and resecured. By pivoting the limiting surface, the pitch, or radial rate of recession of the limiting surface can be altered to suit any new operating conditions. Thus, where a change in operating conditions requires a different rate of recession for the limiting surface, the position of the limiting surface can be adjusted to achieve the desired result. In this manner an effective limiting device over a range of operating conditions can be provided for the control of undesired wood movement during processing. In another embodiment the position of the limiting surface can be moved relative to a centre of rotation by translation, which alters in an analogous fashion the rate of recession to accommodate changes in operating conditions.

Thus, according one aspect of the present invention there is provided a wood processing device comprising:

a rotatable wood processing head having one or more spaced apart knives mounted on said rotatable head for processing wood, said knives, upon contacting said wood, forming a curved cut surface in said wood being processed;

at least one limiting surface on said rotatable head against which said curved cut surface of said wood can abut to limit abnormal movement of said wood during processing; and an adjustor for adjusting said limiting surface to permit said limiting surface to limit abnormal movement of said wood over a range of operating conditions.

According to a second aspect of the present invention there is provided a wood processing device comprising:

a rotatable wood processing head having one or more spaced apart knives mounted on said rotatable head for processing wood, said knives, upon contacting said wood, forming a curved cut surface in said wood being processed;

at least one limiting surface on said rotatable head against which said curved cut surface of said wood can abut to limit abnormal movement of said wood during processing; and an adjustor for adjusting said limiting surface and said knives in unison to permit said limiting surface to limit abnormal movement of said wood over a range of operating conditions.

Further according to another aspect of the present invention there is provided a method of operating a wood processing device having a rotatable head where said rotatable head carries one or more knives which form a curved cut surface in the wood being worked, said wood processing device including a limiting surface for preventing abnormal movement of said wood during processing, said method comprising the steps of:

changing one or more machine settings to suit a change in operating conditions;

unlocking said limiting surface from said rotatable head;

adjusting a position of said limiting surface on said head to permit said limiting surface to prevent abnormal movement of said wood during processing at said changed operating conditions; and locking said limiting surface in place at said adjusted position on said rotatable head.

BRIEF DESCRIPTION OF THE DRAWINGS

Reference will now be made to various figures which depict, by way of example only, preferred aspects of the present invention and in which.

DETAILED DESCRIPTION OF THE PREFERRED EMBODIMENTS

Figure 1:
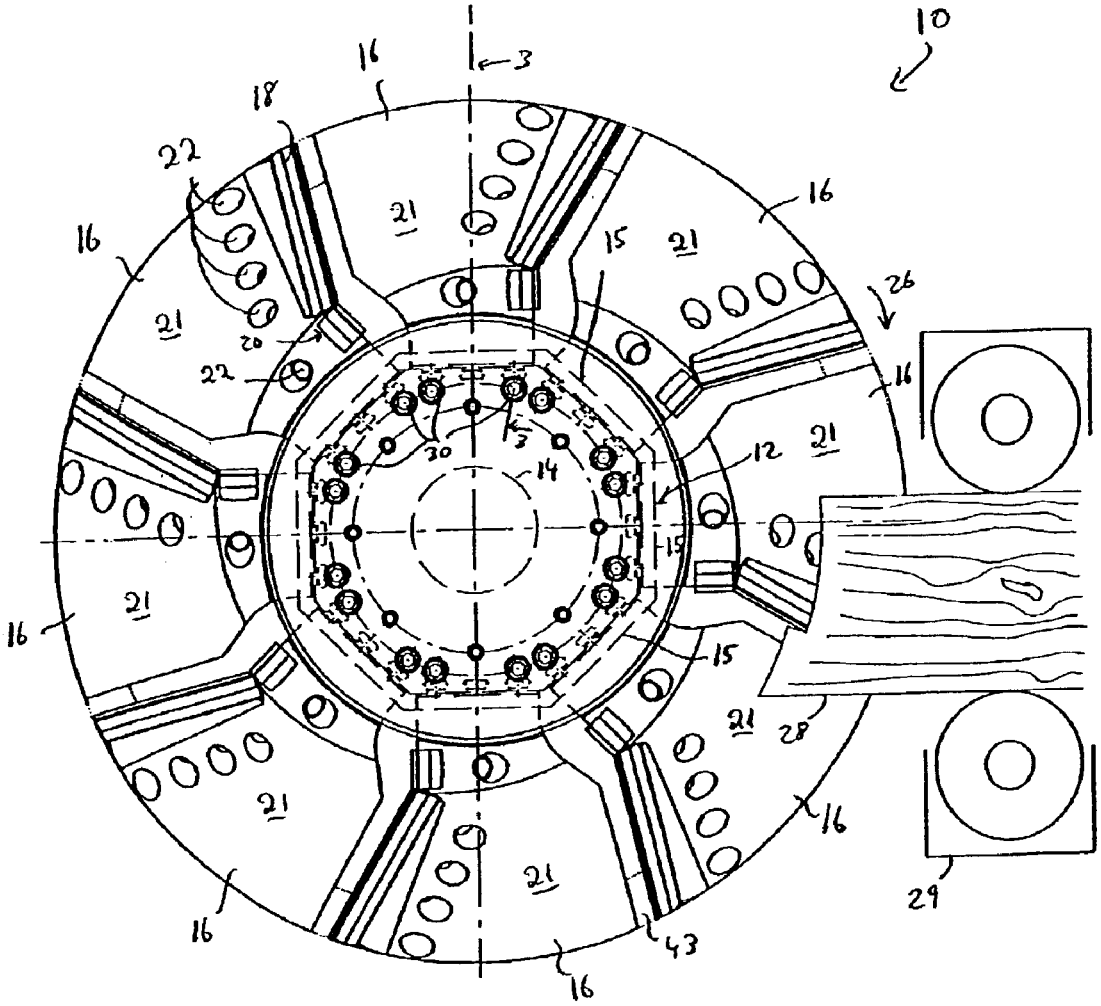
FIG. 1 is a side view of a conical chipping head having an adjustable limiting surface according to a first embodiment of the present invention.

FIG. 1 shows a rotatable eight knife conical chipping head 10 which is one form of implementation of the present invention. The conical chipping head 10 is comprised of a central hub 12 having a drive shaft 14 to which are attached a plurality of knife mounting base members 16. Preferably the hub 12 is in the form of an octagon, where each face of the octagon forms a mounting face 15 for each segment 16. While an octagon hub with eight base members is shown as a preferred example, it will be recognized by those skilled in the art that other arrangements would also work. Each base member 16 includes a pair of knife clamping assemblies mounted from the underside with a relatively longer first cutting knife 18 and a shorter finishing knife 20. The configuration of the cutting knives 18, 20 is according to a common arrangement for such heads, and as shown, uses blades of the indexable, or turnable type. For each of the base members 16, a plurality of recessed bolts 22 are provided. By loosening or tightening the bolts 22, the knives 18, 20 can be released or secured in the knife assemblies. Thus, as knives become worn, the knives 18, 20 can be turned or replaced as needed. On the outer periphery of base member 16 is mounted a curved limiting surface 21, as explained in more detail below.

Figure 2:
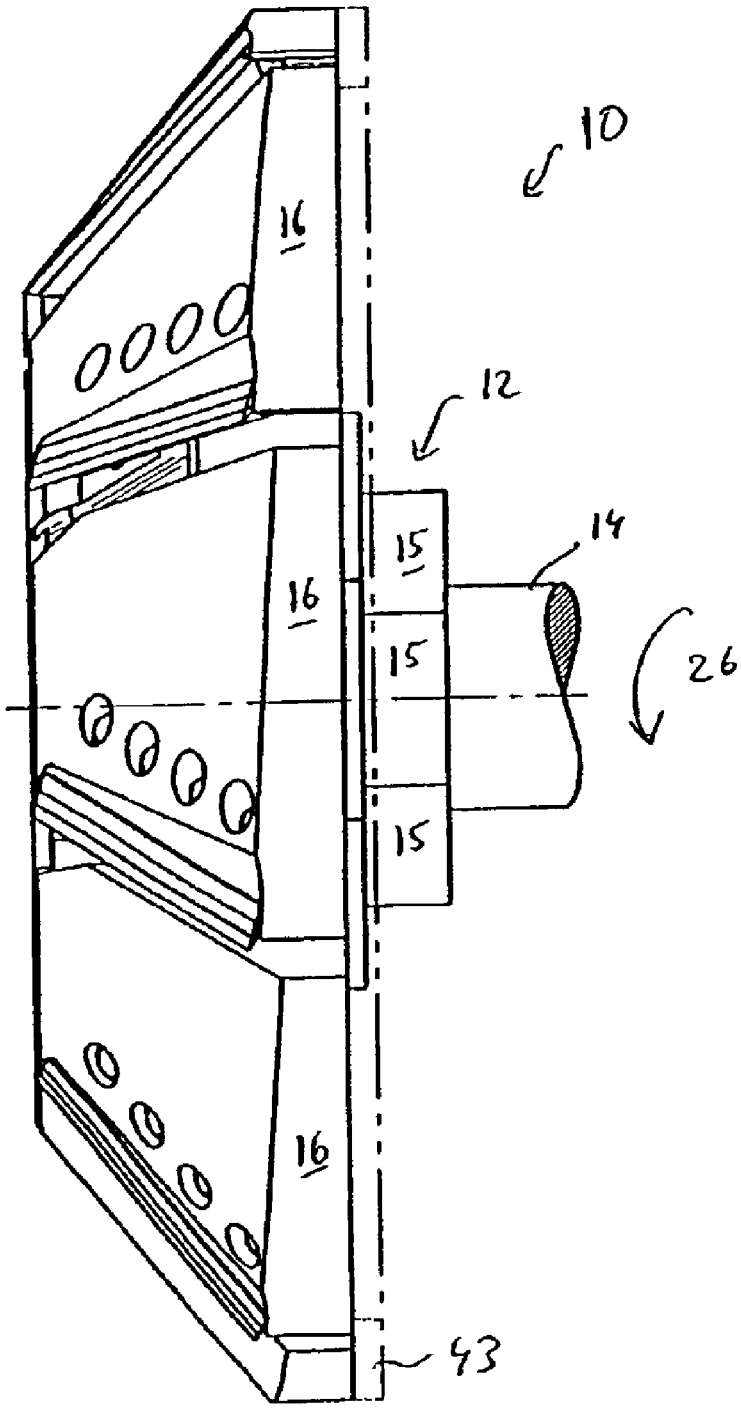
FIG. 2 is a front view of the conical chipping head of FIG. 1.

FIG. 2 shows a front view of the conical head of FIG. 1. The base members 16 are shown as well as the drive shaft 14. The drive shaft 14 is connected to a drive mechanism powered by a motor (not shown) which rotates the head 10 in the direction of arrows 26. As shown in FIG. 1, wood 28 is fed into the path of the knives 18, 20 by a feed mechanism 29.

Figure 3:
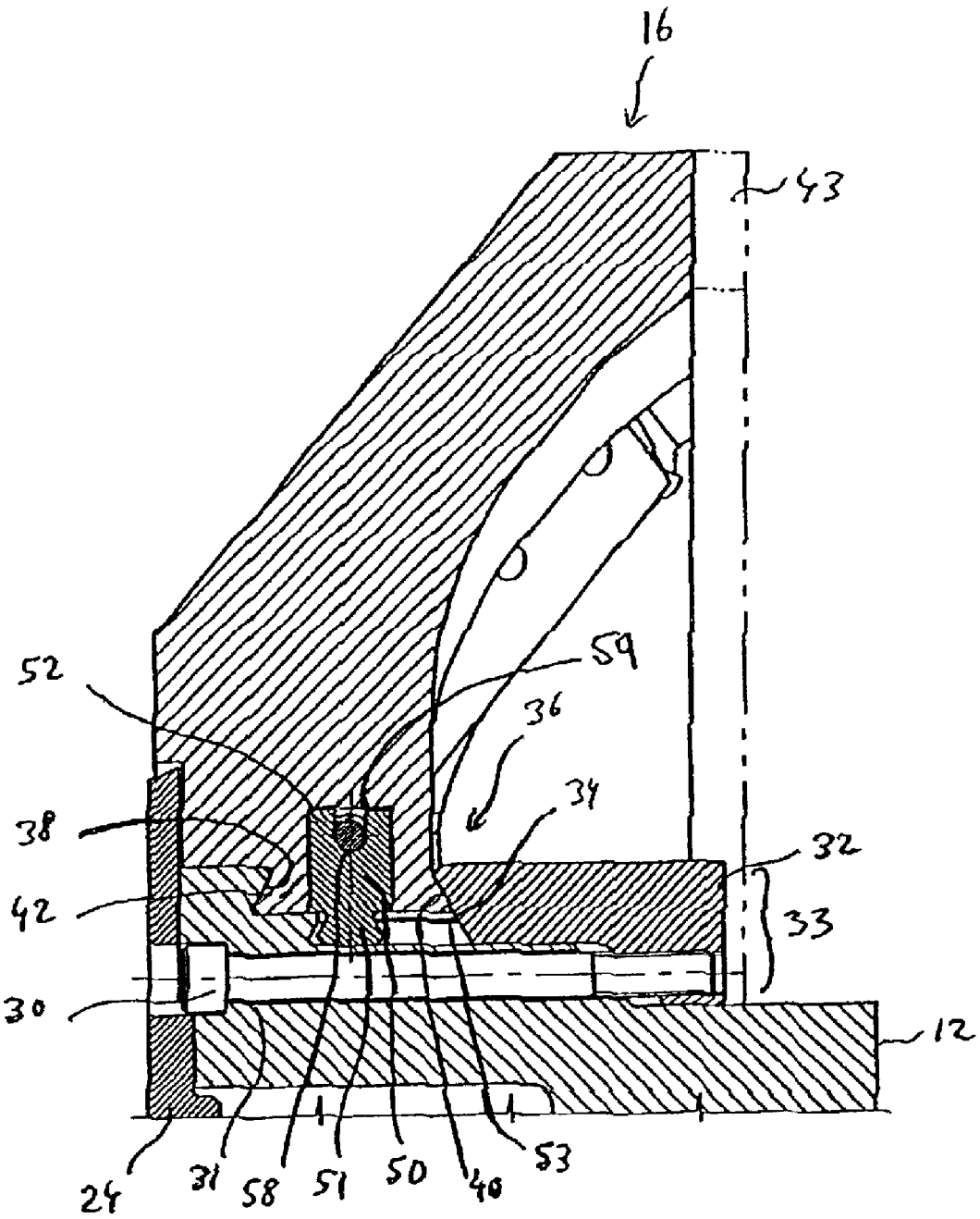
FIG. 3 is a cross-sectional view through line 3—3 of FIG. 1.

FIG. 3 is a cross-sectional view through the bottom of one of the base members 16 and the hub 12 along the lines 3—3 in FIG. 1. As can be seen, the hub 12 includes an adjuster 33, which in this embodiment includes a clamping system having a clamping element 32 and an actuator 30. In this description adjuster means generally a mechanical structure by which the position of the limiting surface 21 may be moved, from one secured position to another secured position. The clamping system is thus one implementation of an adjuster 33 according to the present invention. The actuator 30 is in the form of a pair of parallel threaded bolts (of which only one can be seen in FIG. 3) which pass through bores 31 in the hub 12 and thread into clamping element 32. As the bolts 30 are tightened or loosened, the clamping element 32 can be moved in or out of a clamping position. The clamping element 32 includes an inclined clamping face 34 which interacts with a corresponding inclined seating surface generally at 36 of the base member 16. The bottom of the base member 16 is of a dovetailed cross section having opposed inclined faces 38 and 40. The clamping element 32 clamps against inclined face 40. The hub 12 is formed with a mating undercut face 42 against which base face 38 is clamped as the bolts 30 are tightened. Thus, when the bolts 30 are made tight, the clamping element 32 clamps the dovetail portion of the base member 16 in place. A front face plate 24 is secured to the side of the hub 12 although the present invention comprehends that a circular saw can be used in place of face plate 24.

Because of the tremendous forces generated during wood processing, it is also necessary to secure the clamping element 32 onto the hub 12. Therefore, there is preferably provided a dovetail tongue and groove joint between the hub 12 and clamping element 32. This arrangement is particularly advantageous as, in conjunction with the dovetail shaped tongue formed by inclined surfaces 38 and 40, the base member 16 can be reliably secured to the hub 12, as described in more detail below, while remaining quite compact. This permits the invention to be used across a broad range of heads including miniature conical heads where the small size of the hub can preclude other mounting arrangements due to the lack of space. This compact attachment is achieved in part by the dovetail base portion of the base member extending in a direction transverse to the axis of rotation of the rotatable head, rather than being parallel to the direction of rotation (i.e. axially) as shown in U.S. Pat. No. 5,816,301. A benefit of the present invention is that it ensures that all the base members can be quickly and easily secured in the same axial position on the hub while providing a mounting which is secure against the significant forces generated during wood processing. To help secure the base members 16, a rear retaining ring 43 may also be used to fasten the outer edges of the base members 16 together.

According to the present invention it is also desirable to permit the position of the base member 16 to be changed on the hub 12. As will be explained in more detail below, changing the position of the base member 16 on the hub 12 changes the position of limiting surface 21 and permits the limiting surface to be positioned to suit specific operating conditions. It shall be understood that in this context, changing a position of a base member 16 comprehends translating the limiting surface 21 on the hub, rotating the limiting surface 21 on the hub, or a combination of both translation and rotation to alter the position of the limiting surface. Further, while reference is made herein to a curved limiting surface, other shapes of limiting surface may also be used. For example, a limiting surface 21 made from a series of flat sections which approximate a curve can also work. Even having one planar section may be acceptable in some cases. However a smoothly curved surface which approximates the form of the curved cut surface in the wood, such as a helix or a spiral of Archimedes, is believed to be the most preferable form of limiting surface.

As shown in FIG. 3, an anchor post 50 is positioned between the base 16 and the hub 12. The anchor post 50 includes a button-shaped anchor portion 51 and a post-shaped top portion 52. The button-shaped anchor portion 51 is slid into a slot 53 located on the hub 12. By means of the slot sidewalls, the post 50 is held in place against translation in a direction orthogonal to the axis of rotation of the hub 12.

Figure 4:
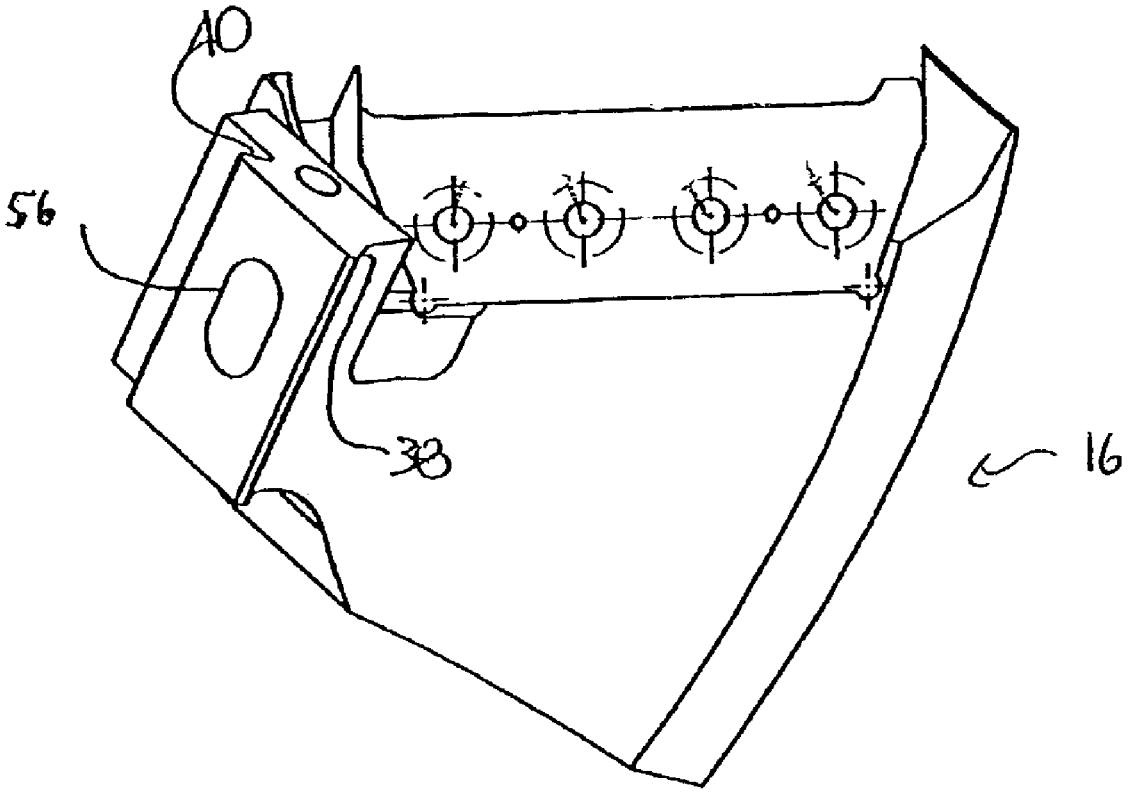
FIG. 4 is a bottom perspective view of a base member of the conical chipping head of FIGS. 1 to 3.

Turning to FIG. 4, the underside of a base member 16 is visible. As seen, there is an anchor post mounting slot 56 formed in the underside of the base member 16. The slot 56 permits the base member 16 to be translated in a direction orthogonal to the axis of rotation with respect to the hub 12.

Figure 5:
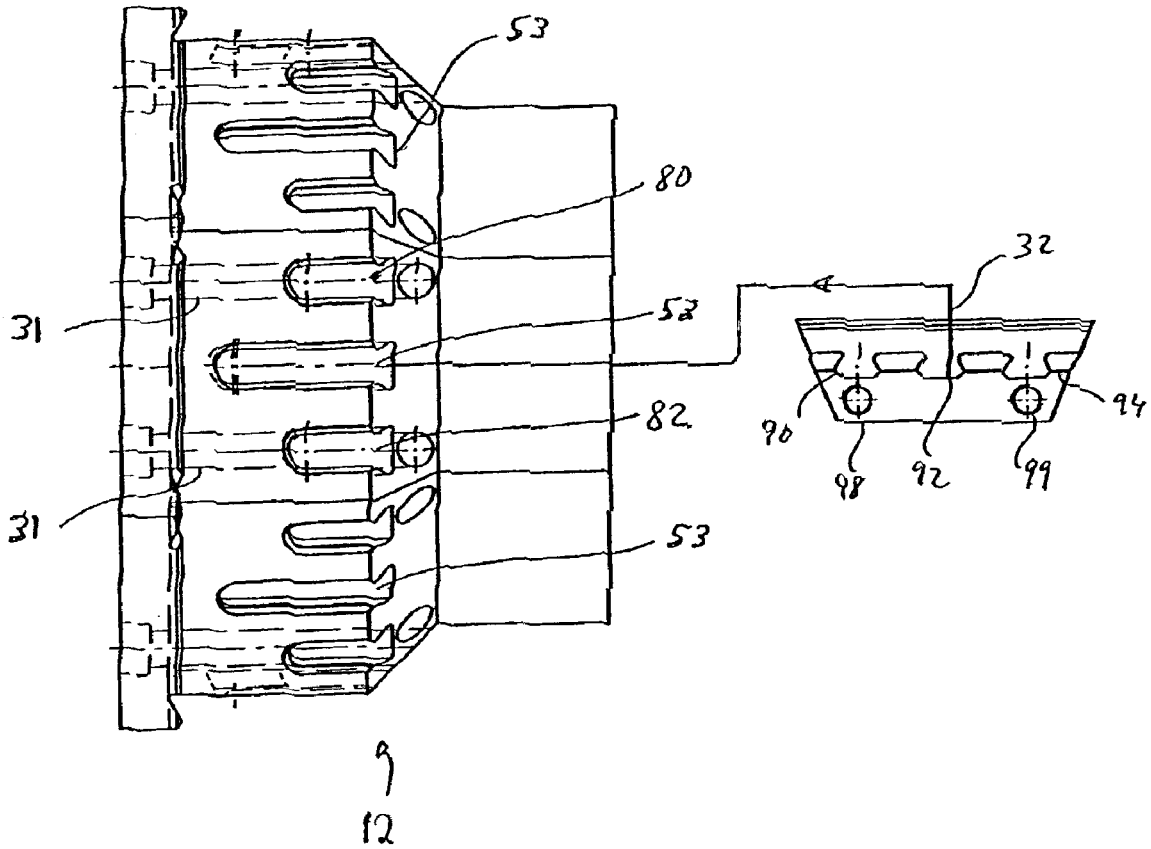
FIG. 5 is a side view of a central hub of the conical chipping head of FIGS. 1 to 3 with the base members removed and showing an end view of a clamping element.

It will be understood by those skilled in the art that the anchor post 50 permits the translation of the base member 16 laterally on the hub 12 within the limits established by the slot 56. However, because of clamping element 32, base member 16 is not permitted to move axially (i.e. in a direction parallel to the drive shaft 14). In this way, adjustments can be made to the position of the base member 16 relative to the centre of rotation of the hub 12, without significantly altering the axial position of the finishing knives 20 contacting the wood being fed into the head 10. Translation of the base member 16 on the hub 12 is controlled by threaded rod 58, which acts as a translating member for the base member 16. A yoke 59 is formed in rod 58 which sits in anchor post 50. The yoke 59 permits the rod 58 to spin about its longitudinal axis in the post 50 while restricting any longitudinal movement. As the rod 58 is threaded through base member 16, rotation of the rod 58 translates the base member 16. Thus, by turning rod 58, the base member 16 can be accurately located in a range of positions defined by the slot 56. However it will be understood that the present invention comprehends that other means of translation may be used without departing from the scope of the invention Turning to FIG. 5, the hub 12 is shown without the base members 16. The slots 53 for the knife locating posts 50 for each base member 16 are shown together with dovetail slots 80 and 82 which are located generally above through holes 31 for the bolts 30. It will be appreciated that there are two bolts for tightening each clamping element 32 against the base member 16 although more or fewer bolts may be used. Also shown in FIG. 5 is an end view of a clamping element 32. As shown, three dovetail tongues 90, 92, 94 protrude from the underside of the clamping element 32. Each tongue fits into a dovetail slot, so that 90 fits into slot 80, 92 into slot 53, and 94 into slot 82. Also shown are threaded holes 98, 99 into which the bolts 30 are fastened. It can now be appreciated that the clamping element 32 can be advanced or retreated from a clamping position by tightening or loosening the bolts 30. This moves the clamping element 32 in a direction parallel to the axis of rotation of the hub 12, as the dovetail tongues 90, 92, 94 slide in their respective slots 80, 82, and 53. Further, since the slots are dovetailed the clamping element 32 is restricted from movement in all other directions thus securing the base member 16 against the extreme cutting forces when bolts 30 are tightened. FIG. 1 shows in ghost outline the tongues 90, 92 and 94 in their respective slots. It will be appreciated by those skilled in the art that other tongue and groove designs can also be used, such as T-shaped slots, without departing from the scope of the present invention.

Figure 6:
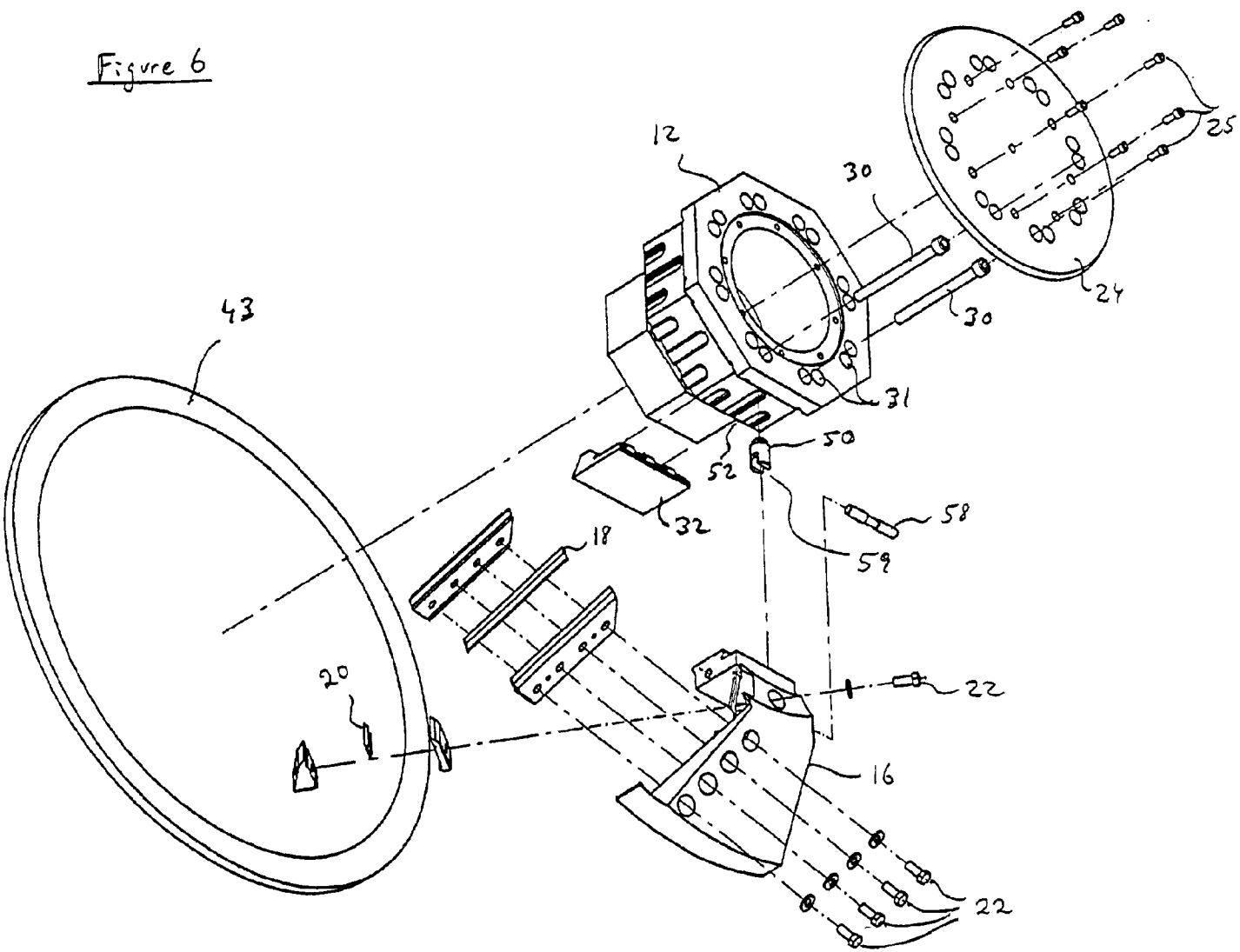
FIG. 6 is an exploded view of the attachment of one base member to a hub according to FIGS. 1 to 5.

FIG. 6 shows, in exploded view, the attachment of one base member 16 to the hub 12. Also shown are bolts 22 for the fastening of knives 18, and 20 into their respective knife assemblies. Face plate 24 is attached to the hub 12 by fasteners 25. Anchor post 50 fits into slot 53, and threaded rod 58 fits into the yoke 59 in the anchor post 50. The base member 16 is secured by clamping element 32 drawn in by bolts 30 passing through bores 31. As well a retaining ring 43 is shown in ghost outline.

The operation of the first embodiment of the invention can now be understood. Consider that it becomes necessary to adapt the machine to a change in operating conditions, for example to a change in the chip size being produced. In such a case it can now be appreciated that by loosening the bolts 30 the clamping element 32 can be backed off permitting each base member 16 to be translated on the hub 12 by turning rods 58. In this sense each base member 16 will be translated in a direction perpendicular to the axis of rotation of the hub 12 along one of the octagonal flat mounting surfaces. Because of the anchor post 50, the repositioning can only take the form of laterally translating the base member 16 along the flat side the hub 12. In this way, translation of the base member 16 changes the position of the limiting surface 21 relative to the centre of rotation and thus alters the recession of the surface to more properly suit the new operating conditions for the wood being processed in the machine.

Figures 7, 7A:
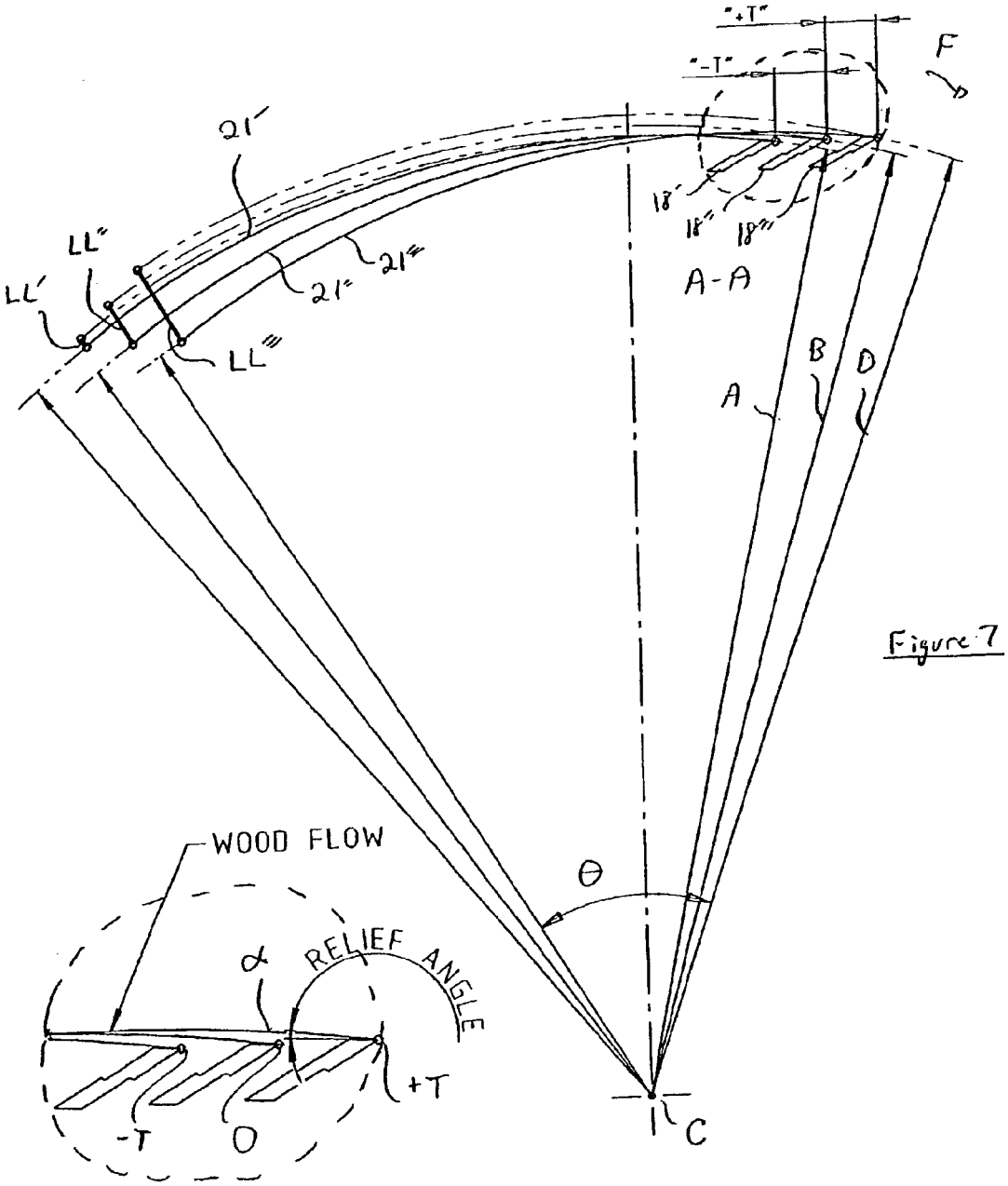
FIG. 7 is a pictorial showing a translational change of position of a limiting surface of the embodiment in FIGS. 1 to 6.
FIG. 7A is a close up of circle A—A of FIG. 7.

Turning to FIG. 7, which is a pictorial of a change of position of a base member 16 on hub 12, the effect of a translation according to the present invention can now be understood. One of the knives 18 is shown schematically, but located at three different positions 18', 18" and 18'", each corresponding to a different position of the base member 16 on the hub 12. If 18" is in the centre of the range of movement of the base member 16 on the hub 12 (defined by the slot 56), then 18' corresponds to a rearward (in terms of the direction of rotation of the head) lateral displacement of "−T" and 18'" corresponds to a forward lateral displacement of "+T". The centre of rotation for hub 12 is shown at C. Rotation occurs in the direction of arrow F, for forward. As shown, a lateral translation of the base member 16 on the hub 12 has an effect on the position of the cutting edge of the knife shown as 18', 18" and 18'", relative to the centre point C. Essentially, as the knife edge is translated, a different cutting radius is defined. As drawn, the cutting radius for 18' is A, for 18" is B and for 18'" is D. A is slightly shorter than B which in turn is slightly shorter than D.

Of most importance, the lateral displacement "T" has an effect on the rate of recession of the limiting surface 21. As drawn there are three positions for the limiting surface 21 at 21', 21" and 21'" each of which corresponds to respective knife edge positions 18', 18", and 18'" and has a different rate of recession relative to the centre of rotation C. Surface 21' has the least rate of recession and 21'" has the greatest. It can be seen that the difference in cutting circles defined by cutting radii A, B, and D and the maximum point of recession of the cam limiting surface 21', 21", and 21'" can be increased or decreased for a relatively constant angular rotation "θ". In this fashion, the amount surfaces 21', 21", and 21'" will recede radially inward for a fixed amount of angular rotation can be varied. By altering the rate of radial recession of the limiting surface, the movement of the wood in a direction that is radial to the head is thereby limited. For any given cutting location on the head, this restricts the maximum chip length produced. As will be understood by those skilled in the art, the maximum chip length, or limited chip length will only occur if feed rate of the wood from the feed mechanism is such that the limiting surface 21 defines the position of the wood.

It should be appreciated that in this embodiment of the present invention that the knives 18, 20 are mounted to the base member 16, which carries limiting surface 21. This allows the radial rate of recession of both the limiting surface 21 and the outward projecting surface of the knife 18 to be varied simultaneously, and in unison, simply by translating the position of the base member 16 on the hub 12. Moving the base member 16 forward, relative to the direction of rotation of the hub 12, will increase the rate of recession of both the knife 18 and the limiting surface 21, whereas moving the member 16, rearward (relative to the rotation direction of the hub 12) will reduce the rate of recession. What has been discovered is that all points on the displaced limiting surface 21 are within very close proximity to their ideal theoretical position at each point in the translation. In other words, the variance in the rate of recession of the limiting surface 21 is appropriate for the change in position of the knife 18 when they are moved together. Thus, to place the limiting surface 21 in the correct position requires knowing the cutting location on the head 10 and then adjusting the base member 16 to the appropriate position to achieve the desired limited chip length.

The effect of translation on the rate of recession of the knife 18 is best illustrated by examining the clearance angle, or relief angle, that is formed between the wood flow and the top (outward projecting) surface of the knife 18. In FIG. 7A the knife relief angle "α" is shown at the three positions ("−T", "O", "+T"). As can be seen, angle "α" is substantially identical in each position. As will be understood by those skilled in the art, the knife relief angle "α" is critical to the smooth operation of a wood processing device. Experience has shown that the range of acceptable knife relief angles is limited generally to between about 1° to 5°, with the ideal range between about 2° to 3°. As the knife relief angle increases beyond these acceptable values, problems can be encountered with the wood being drawn into the chipping head. Similarly, difficulties with wood feed can be encountered if the relief angle is below the acceptable range. However as FIG. 7A demonstrates, according to the present invention, the translation of the base member 16 on the hub results in a knife relief angle "α" that is maintained relatively constant such that it can remain close to ideal values. It is therefore possible to adjust the limiting surface 21 to the appropriate position to achieve the desired limited chip length while simultaneously adjusting the knife relief angle "α" to remain within the range of acceptable values necessary for smooth operation. This result is achieved in the present invention without the need for any separate angle adjustment of the knife 18 relative to the base member 16.

Figure 8:
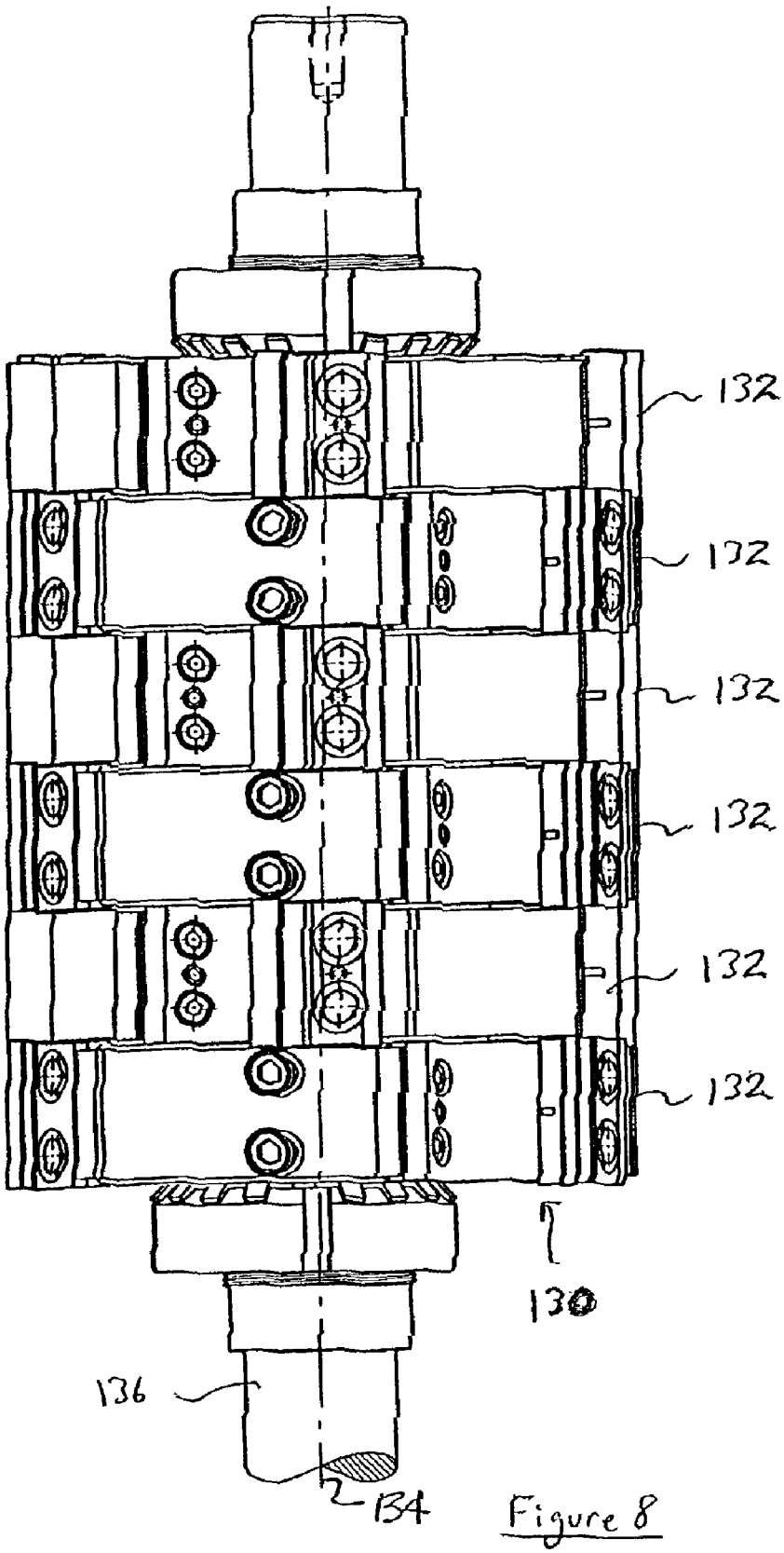
FIG. 8 is a side view of a cylindrical cutting head with a second embodiment of an adjustable limiting surface according to the present invention.

FIG. 8 shows a second embodiment of the present invention associated with a rotatable cylindrical chipping head 130. The head 130 includes an axis of rotation 134, centred on a drive shaft 136. A number of cylindrical spindles 132 are shown attached to drive shaft 136.

Figure 9:
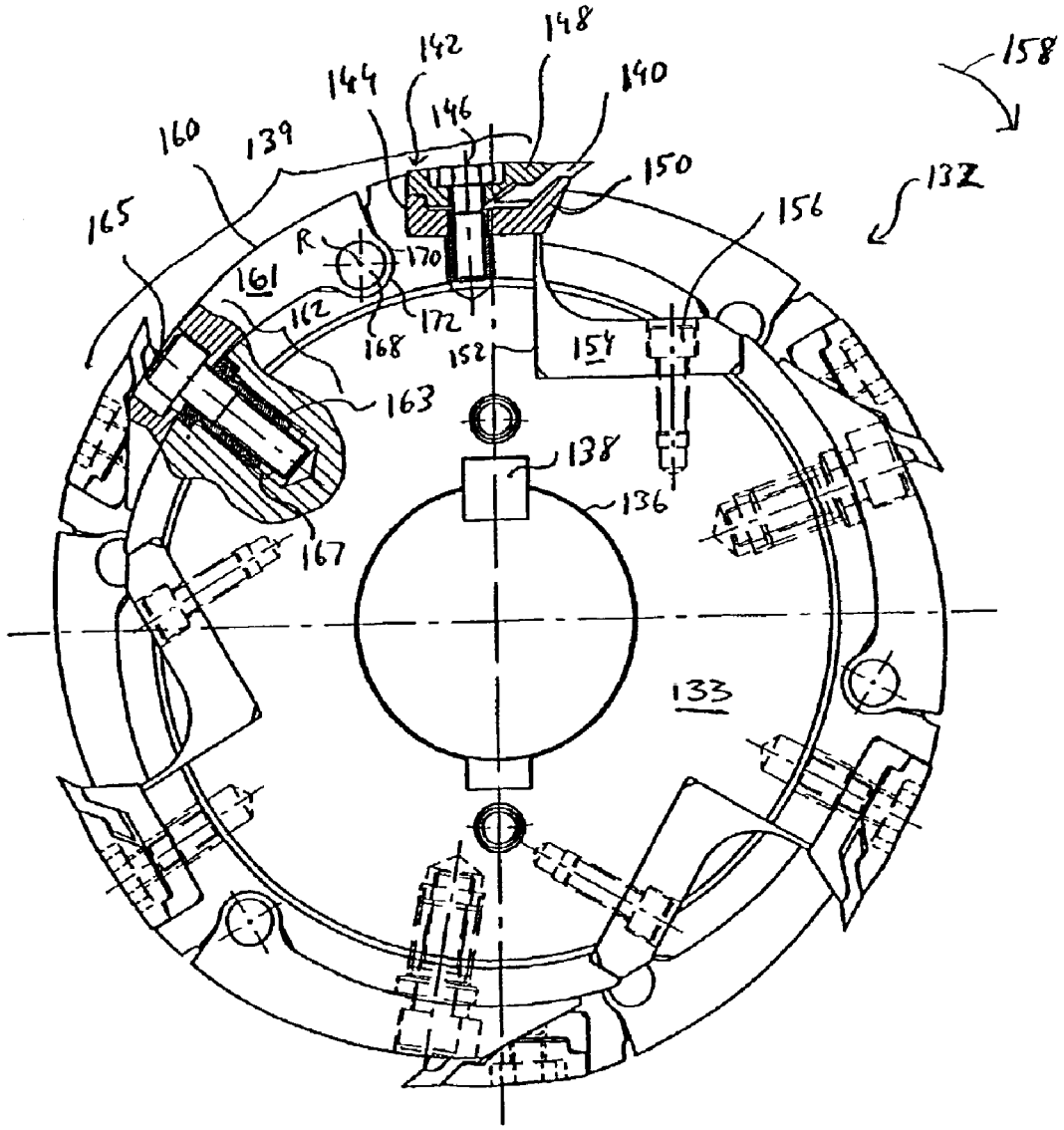
FIG. 9 is a view of one segment of the embodiment of FIG. 8.

FIG. 9 shows one of the cylindrical spindles 132 comprised of a hub, or segment 133. Keyways 138 are used to engage each of the segments 133 to the drive shaft 136. Located about the periphery of the segment 133 are three identical structures 139. While only one is described in detail, it will be understood that the others may be made substantially identical. Further, while three structures 139 are shown by way of example, it will be understood that more or fewer could be provided without departing from the scope of the present invention.

The first element of the structure 139 is a knife 140 in a knife clamping assembly 142 which is held in a pocket 144 by a pair of fasteners 146 (of which only one can be seen in FIG. 9). The knife clamping assembly includes an upper clamping element 148 and a lower clamping element 150. In an adjacent pocket 152, a combination wear element and chip guide 154 is held in place by a second pair of fasteners 156 (of which only one is visible in FIG. 9). Drive shaft 136 is connected to a drive mechanism (not shown) which rotates the head in the direction of arrow 158.

Located between each of the knives 140 is a base member, or limiter, 161 on which is mounted a limiting surface 160. Unlike the previous embodiment, the base member 161 does not carry the knives. The limiter 161 includes a position adjustor assembly 162 to pivot the limiter 161 to alter the radial rate of recession of the limiting surface 160. The position adjustor assembly includes a pair of foundation screws 163 and locking screws 165 of which only one can be seen in FIG. 9. To reposition the limiter 161 the foundation screws 163 may be rotated in or out to pivot limiter 161 about pivot pin 168. Thus the pivot pin 168 defines a pivot axis R for limiter 161, which is generally parallel to the axis of rotation of the drive shaft 136. The foundation screws 163 are each threaded into threaded holes 167 in segment 133. The limiter 161 is caught (or locked) between the locking screws 165 and the foundation screws 163. By rotation, the locked position can be raised or lowered permitting adjustment of the limiting surface 160.

The pivot pin 168 is located in a curved toe 170 of the limiter 161. In turn the curved toe 170 is located in a curved recess 172 formed in the segment 133. The curved toe 170 and the curved recess 172 are made of complementary sizes and shapes so that the limiter 161 is permitted a limited range of positional adjustment relative to the segment 133. It can now be appreciated that the radial recession of the limiting surface 160 can be made to recede more steeply or more gradually depending upon the need.

The operation of this embodiment can now be understood. Consider the situation where the operator adjusts a machine setting, such as the head speed or the log feed advancement rate, to suit various operating conditions such as the size of wood being processed or the size of chip desired. The machine can then be started and observations made on the effectiveness of the limiting surface 160 on restricting abnormal movement of the wood, having regard to the chip size, feed rate and head speed. Typically a change of operating conditions will result in the curved limiting surface 160 either receding too slowly or too quickly causing the normal wood flow to be hindered or insufficiently limiting abnormal movement. If a discrepancy is identified, the machine can be stopped and the locking screws 165 loosened to unclamp or unlock the limiter 161. The foundation screws 163 can then be raised or lowered in the threaded holes 167 of segment 133 pivoting the limiter 161 about the pivot pin 168. Once a new position for the limiter 161 is established, the locking screws 163 can be secured to lock the limiter 161 again against any further movement relative to the segment 133.

It may take several iterations for an operator to establish an ideal position for the limiter 161. This is because, until the limiter 161 is well positioned, the radial recession of the limiting surface 160 may be insufficient to allow for a clearance to be maintained with the cut wood surfaces during normal wood feed, or excessive such that an undesirable amount of abnormal wood movement can occur. However, if the machine, when operated again does not run acceptably, the operator will be able to shut it off, adjust the position of the limiter 161, and restart the machine immediately thereafter. If there are further refinements to the position required, then further adjustments to the position of the limiter 161 can be made, until the operator is content that abnormal movement has been limited as effectively as possible while ensuring unhindered wood advancement during normal operation.

According to a further aspect of the present invention the position of the limiter 161 can be set with the aid of a scale or other markings associated with the relative position of the limiter 161 on the segment 133. Thus, if the operator has set the limiting surface 160 to a preferred position for a given head speed, wood size and feed rate, the position can be noted and used for future reference. Of course the precise position of the limiter 161 may be affected by other factors, such as a need to balance the elements on the spinning head, so it may not be possible to exactly position the limiter 161 by the scale or markings alone.

Figure 10:
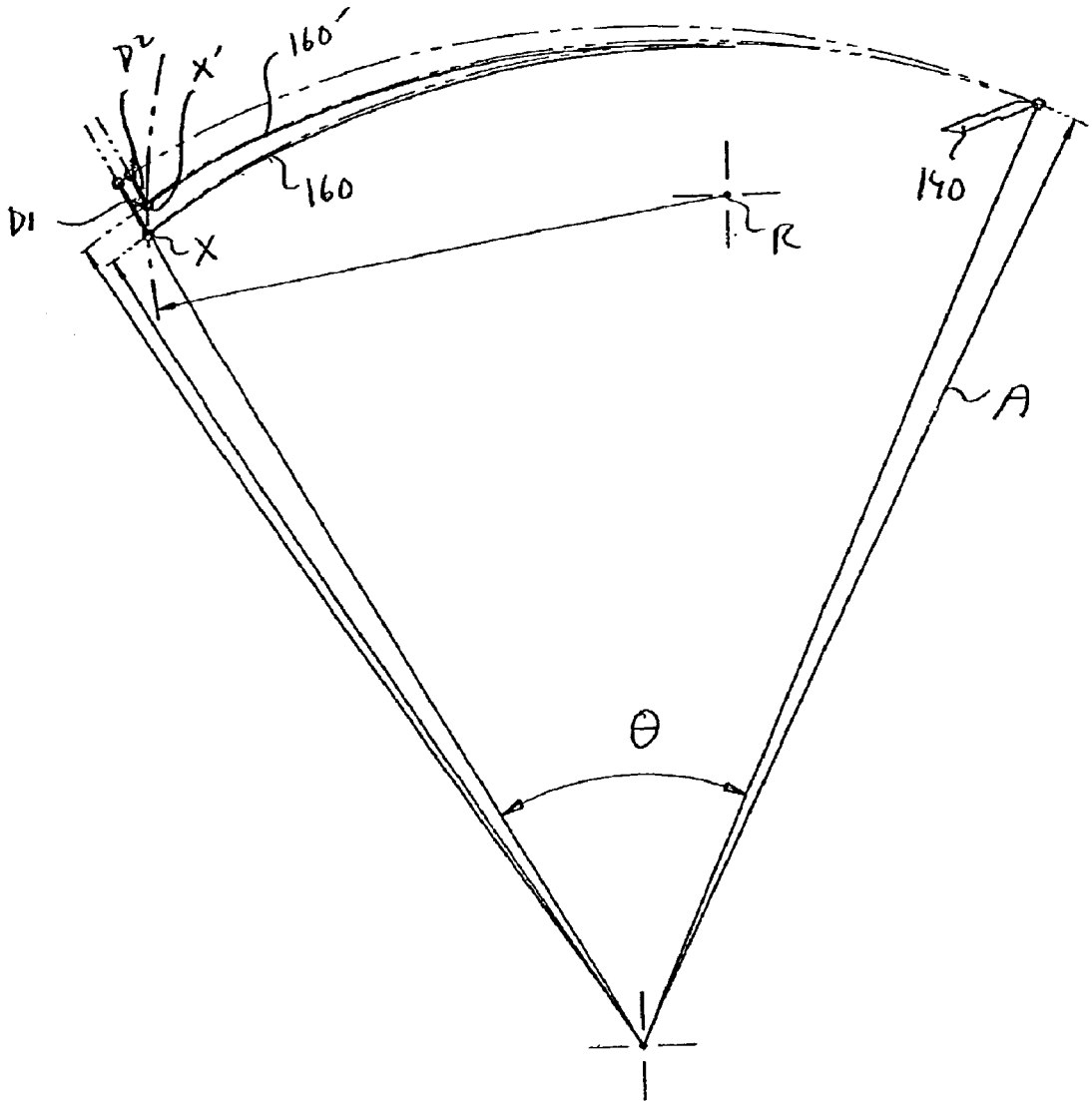
FIG. 10 is a pictorial showing a rotational change of position of a limiting surface of the embodiments of FIGS. 8 and 9.
Figure 11:
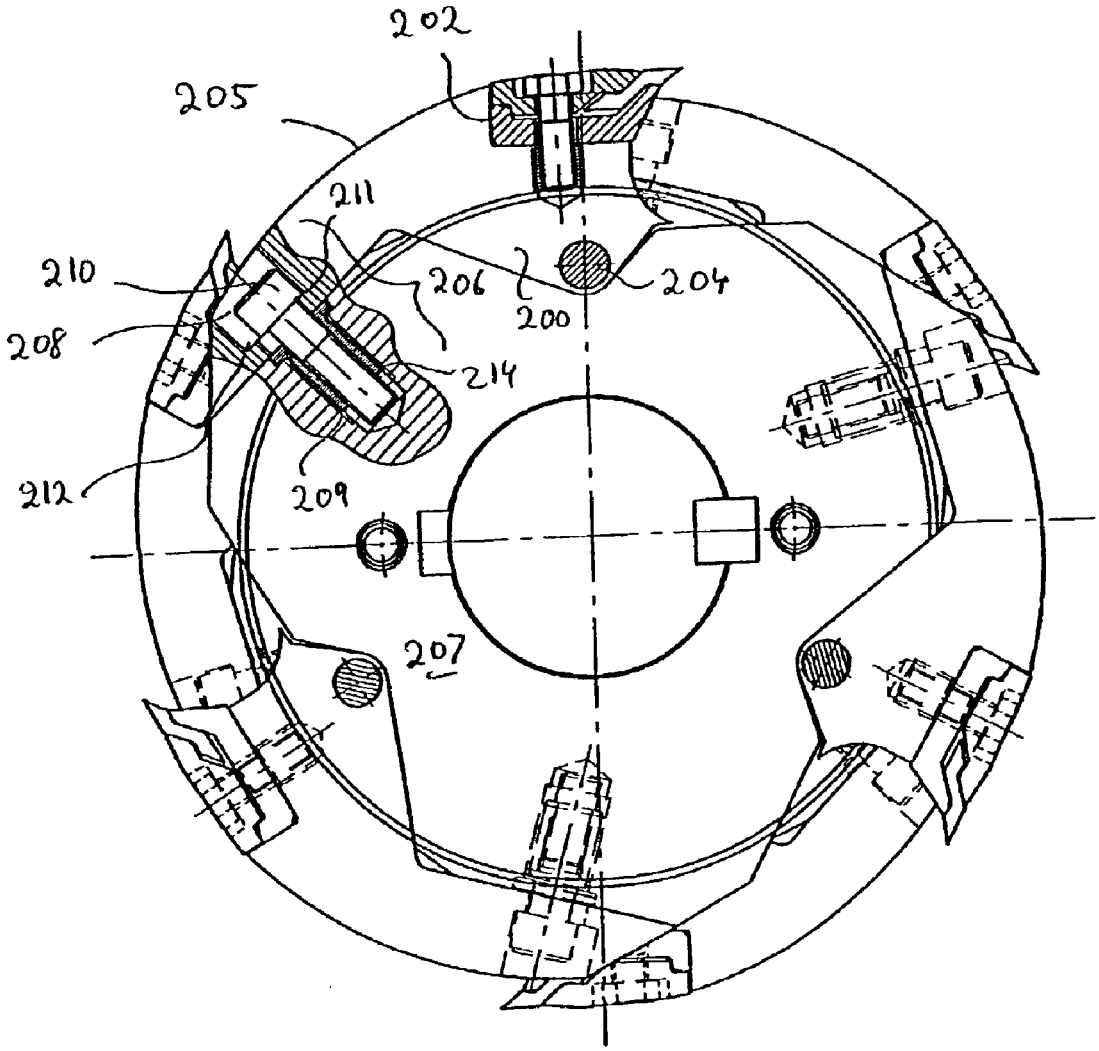
FIG. 11 is a further embodiment of an adjustable limiting surface on a segment of a cylindrical chipping head according to the present invention.

FIG. 10 shows a pictorial of the change in position of a limiting surface 160 where a limiter is pivoted as in the embodiment of FIG. 7. In this case the knife 140 does not change position with the change in the limiter 161. The range of movement (pivoting about axis of rotation R) of the limiting surface 160 is shown between 160 and 160' in FIG. 10. The cutting radius "A" of the knife 140 remains a constant while that of the trailing edge of the limiter surface X, and X' can be increased or decreased for a relatively constant angular displacement "θ". In this fashion, the amount the trailing edge X and X' of limiting surface 160 will recede radially inward from the arc defined by cutting radius A over a relatively constant angular rotation can be varied between D1 and D2. Abnormal movement of the wood in a direction that is radial to the head is thereby limited in a fashion similar to that for the previous embodiment. FIG. 11 shows a further embodiment which is also based on a cylindrical cutting head. A base member 200 is shown, which includes a pocket 202 for a knife clamping assembly, and a curved outer limiting surface 205 mounted on its periphery. This embodiment is analogous to the first embodiment, since as described below, the knife elements and the limiting surface 205 move in unison with one another.

In this embodiment, the base member 200 is pivoted about a pivot pin 204 which is similar in function to the pivot pin 168 previously described. Additionally, a position adjustment assembly 206, equivalent to that of the previous embodiment, is used to pivot the base member 200 about the pivot pin 204. The position adjustment assembly includes locking screw 211 which extends into foundation screw 214 screwed into the threaded hole 209 of segment 207. The locking screw 211 includes a head 210, which bears against the bottom of the recess 208 on surface 212 of the base member 200.

If it is desired to adjust the position of the base member 200 to alter the position of the limiting surface 205, the locking screw 211 is backed off, permitting the foundation screw 214 to be threaded outwards to displace the base member 200 outwardly, away from the segment 207. In this way the position of the base member 200 and thus the limiting surface 205 and the knife elements in the pocket 202 can be adjusted on the segment 207 in a fashion similar to the previous embodiment.

Figure 12:
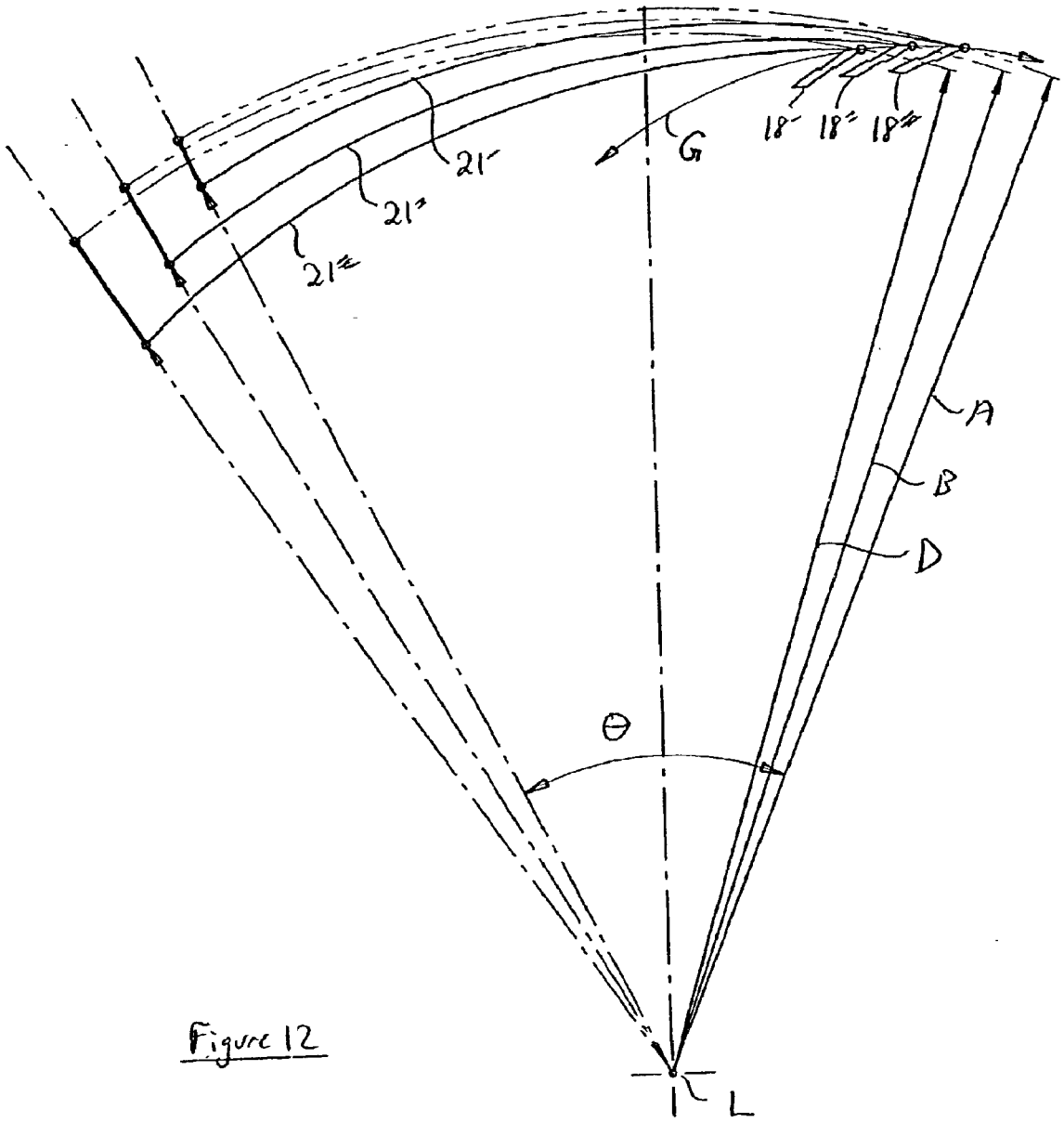
FIG. 12 is a further pictorial showing a change in position of a limiting surface of a further embodiment of the present invention, which combines a rotational and translational positional adjustment.

FIG. 12 is a pictorial of the effect on the knife edge and the limiting surface for a system which combines both translation with rotation, or pivoting, of the limiting surface. This would arise, for example, if the planar surfaces on the hub of the first embodiment were made curved. This type of movement has the effect of displacing the knife edge along a displacement curve, shown as G, between positions 18', 18" and 18'". In general, the operation of this embodiment is similar to that already described. However it will be noted that the difference in cutting circles defined by cutting radii A, B, and D and the maximum point of recession of the cam limiting surface 21', 21", and 21'" is greater over a similarly constant angular displacement "θ" with this type of repositioning. In this fashion, the rate surfaces 21', 21", and 21'" will recede radially inward can be altered to a greater degree when a combination of rotation and translation is employed.

It will be appreciated by those skilled in the art that various modifications and alterations of the invention can be made without departing from the broad scope of the appended claims. Some of these have been discussed above and others will be apparent to those skilled in the art. For example, the present invention comprehends an adjustor which adjusts a position of a limiting surface by means of a translational adjustment, a rotational (pivoting) adjustment, or a combination of both. Further the present invention comprehends having the limiting surface integral with a base member that carries the knives, so that the limiting surface and knife position change as the base member is adjusted, as well as having the limiting surface separate from and independently adjustable from the knife. As well, the present invention may be used on all manner of spinning head wood processing machines including those used for the production of chips, flakes, wafers or shavings.

What is claimed is:

1. A wood processing device comprising:

a rotatable wood processing head having an axis of rotation and having one or more spaced apart knives mounted on said rotatable head for processing wood, said knives, upon rotation sweeping out a conical or cylindrical path and forming a curved cut surface in said wood being processed;

at least one limiting surface adjustably mounted between said one or more knives on said rotatable head, said limiting surface being sized and shaped to limit abnormal movement of said wood transverse said axis of rotation during processing; and an adjustor for adjusting a position of said limiting surface to permit said limiting surface to limit abnormal movement of said wood transverse said axis of rotation over a range of operating conditions.

2. A wood processing device as claimed in claim 1 wherein said limiting surface is radially curved relative to said axis of rotation.

3. A wood processing device as claimed in claim 1 wherein said knives are adjustably mounted to said rotatable head and said knives and said limiting surface are mounted on a common base member wherein an adjustment of said position of said limiting surface simultaneously adjusts a position of said knives.

4. A wood processing device as claimed in claim 3 wherein each of said knives forms a knife relief angle with respect to said wood being processed and said adjustment of said limiting surface is limited to a range wherein said knife relief angle is suitable for wood processing.

5. A wood processing device as claimed in claim 1 wherein said limiting surface is mounted on a base member separate from said knives and adjustment of said position of said limiting surface is independent from a position of said knives.

6. A wood processing device as claimed in claim 3 wherein said base member is mounted on a hub having an axis of rotation, and said adjustor translates said base member on said hub to adjust a position of said limit surface relative to said axis of rotation.

7. A wood processing device as claimed in claim 6 wherein said adjustor translates said base member on said hub in a direction transverse to said axis of rotation.

8. A wood processing device as claimed in claim 3 wherein said base member is pivotally mounted on a hub having an axis of rotation and said adjustor pivots said base member about said pivotal mounting.

9. A wood processing device as claimed in claim 8 wherein said pivotal mounting has a pivot axis that is generally parallel to said axis of rotation of said hub.

10. A wood processing device as claimed in claim 1 or 2 wherein said adjustor changes a radial rate of recession of said limit surface relative to a cutting arc defined by said one or more knives.

11. A wood processing device as claimed in claim 1 or 2 wherein said adjustor is sized and shaped to permit said limiting surface to limit abnormal movement of said wood over a range of wood particle sizes.

12. A wood processing device as claimed in claim 1 or 2 wherein said device further includes a wood feed mechanism for feeding wood to be processed into contact with said knives, said wood feed mechanism operating over a range of wood feed rates and wherein a change in wood feed rate results in a change of shape of said curved cut surface formed in said wood being processed and wherein said adjustor is sized and shaped to permit said limiting surface to limit abnormal movement of said wood over a range of feed rates of said feed mechanism.

13. A wood processing device as claimed in claim 1 or 2 wherein said device further includes a drive mechanism for said rotatable head to permit a speed of said rotatable head to be varied over a range of speeds wherein a change in speed results in a change of shape of said curved cut surface formed in said wood being processed, and wherein said adjuster is sized and shaped to permit said limiting surface to limit abnormal movement of said wood over a range of speeds of said drive mechanism.

14. A wood processing device as claimed in claim 1 wherein said rotatable head includes at least two equally spaced apart knives and said limiting surface is a smoothly curved surface extending generally between successive knives.

15. A wood processing device as claimed in claim 2 or 14 wherein said limiting surface is in the form of a spiral of Archimedes.

16. A wood processing device as claimed in claim 2 or 14 wherein said limiting surface is in the form of a helix.

17. A wood processing device as claimed in claim 1 wherein said limiting surface is releasably attached to said head within a range of positions.

18. A wood processing device as claimed in claim 17 wherein said limiting surface is pivotally-mounted to said head.

19. A wood processing device as claimed in claim 17 wherein said limiting surface is slidably attached to said head.

20. A wood processing device comprising:

a rotatable wood processing head having an axis of rotation and having one or more spaced apart knives adjustably mounted on said rotatable head for processing wood, said knives, upon rotation sweeping out a conical or cylindrical path and forming a curved cut surface in said wood being processed;

a relief angle formed between said one or more knives and said curved cut surface; and an adjustor for adjusting a position of said one or more knives such that said knife relief angles are maintained within a range suitable for the processing of said wood over a range of operating conditions.

21. A base member for a wood processing device having a rotatable head said base member comprising:

a body;

at least one knife projecting from said body;

a limiting surface located behind said knife on said body; and a means for adjustably attaching said body to said rotatable head, said adjustable attachment means permitting said body to be positioned on said head to permit said limiting surface and said knife to be simultaneously positioned.

22. A method of operating a wood processing device having a rotatable head where said rotatable head has an axis of rotation and carries one or more knives which form a curved cut surface in wood being worked, said wood processing device including a limiting surface for preventing abnormal movement of said wood transverse said axis of rotation during processing, said method comprising the steps of:

changing one or more machine settings to suit a change in operating conditions;

unlocking said limiting surface from said rotatable head;

adjusting a position of said limiting surface on said head relative to said axis of rotation to permit said limiting surface to prevent abnormal movement of said wood during processing transverse said axis of rotation at said changed operating conditions; and locking said limiting surface in place at said adjusted position on said rotatable head.

23. A wood processing device having a rotatable wood processing head having an axis of rotation, said wood processing device comprising:

a hub having at least one fixed clamping face;

at least one clamping element moveably mounted to said hub said at least one clamping element being sized and shaped to permit said at least one clamping element to be moved towards said at least one fixed clamping face along an axis parallel to an axis of rotation of said rotatable head, but restrained from movement in any other direction; and at least one base member for carrying one or more cutting knives, said base member being sized and shaped to be clamped between said at least one fixed clamping face and said at least one clamping element, said fixed clamping face and said one clamping element being positioned to permit, when unclamped, movement of said base member in a direction transverse to said axis of rotation.

24. A wood processing device as claimed in claim 23, wherein said at least one clamping element includes an inclined clamping face and said at least one fixed clamping face of said hub includes an opposed inclined clamping face and said at least one base member is clamped between said opposed inclined clamping faces.

25. A wood processing device having a rotatable wood processing head as claimed in claim 23 wherein said at least one fixed clamping face is transverse to said axis of rotation.

26. A wood processing device having a rotatable wood processing head as claimed in claim 24 wherein said opposed inclined clamping faces are orthogonal to said axis of rotation.

27. A wood processing device having a rotatable wood processing head as claimed in claim 23 further including an anchor post extending between said at least one base member and said hub.

28. A wood processing device as claimed in claim 27 wherein said anchor post fixes said at least one base member in a direction transverse to said axis of rotation.

29. A wood processing device having a rotatable wood processing head as claimed in claim 27 wherein one of said at least one base member and said hub includes an anchor post slot, said slot permitting said at least one base member, when unclamped, to be moved in a direction transverse to said axis of rotation of said rotatable head.

30. A wood processing device having a rotatable wood processing head as claimed in claim 23 wherein said device further includes a translating member for translating said at least one base member on said hub.

31. A wood processing device having a rotatable wood processing head as claimed in claim 23 wherein the means for permitting said clamping element to move in a direction parallel to said axis of rotation, while restraining movement in any other direction, comprises one or more tongue and groove joints between said at least one clamping element and said hub.

32. A wood processing device as claimed in claim 31 wherein said one or more tongues and groove joints are of dovetailed cross section.

33. A wood processing device as claimed in claim 31 wherein said one or more tongues and groove joints are of a T-shaped cross section.

34. A wood processing device having a rotatable wood processing head as claimed in claim 23 wherein said device further includes a scale to locate said base member on said hub.

35. A wood processing device having a rotatable wood processing head as claimed in claim 23 further including one or more threaded bolts associated with said clamping element to move said at least one clamping element between a clamped and an unclamped position.

36. A wood processing device having a rotatable wood processing head as claimed in claim 23 wherein said device includes two to twelve base members secured to said hub.

37. A base member for a wood processing device having a rotatable head, said base member comprising:

a body;

at least one knife projecting from said body;

a limiting surface located behind said knife on said body; and a clampable base fixed to said body, said clampable base having at least one clamping face extending transverse to a direction of rotation of said rotatable head.

38. A base member for a wood processing device as claimed in claim 37, wherein said clamping face of said clampable base is inclined and said clampable base includes an opposed second inclined clamping face.

39. A base member for a wood processing device as claimed in claim 38, wherein said opposed inclined clamping faces of said clampable base are generally parallel.

40. A base member for a wood processing device as claimed in claim 39, wherein said opposed inclined clamping faces are generally orthogonal to an axis of rotation of a wood processing device when said base member is mounted thereupon.

41. A base member for a wood processing device having a rotatable head as claimed in claim 37, wherein the body further includes one of a slot or an anchor post, and the hub includes the other of said slot or said anchor post, said slot and anchor post together limiting the range of positions of said body on said hub.

42. A clamp for clamping a base member on a rotatable head of a wood processing device having an axis of rotation, said clamp comprising:

a fixed clamping face fixed to a hub of said rotatable head;

a moveable clamping face moveably mounted to said hub opposite said fixed clamping face; and at least one actuator for drawing the moveable clamping face towards said fixed clamping face to clamp a base member therebetween, said fixed and moveable clamping faces being positioned to permit, when unclamped, movement of said base member in a direction transverse to said axis of rotation.

43. The clamp of claim 42 wherein said actuator is a threaded element.

44. The clamp of claim 42 wherein the direction of movement of said moveable clamping face is along an axis of rotation of said rotatable head.

45. The clamp of claim 42 wherein said fixed clamping face is integrally formed with said hub.

46. The clamp of claim 42 wherein said moveable clamping face includes means for restraining movement in any direction other than along said axis of rotation of said rotatable head.

47. The clamp of claim 46 wherein said means for restraining said moveable clamping face from movement in any direction other than along said axis of rotation is one or more tongue and groove joints between said moveable clamping face and said hub.

48. The clamp of claim 47 wherein said one or more tongue and groove joints are of a dovetailed cross section.

49. The clamp of claim 47 wherein said one or more tongue and groove joints are of a T-shaped cross section.

50. A wood processing device as claimed in claim 2 wherein said knives are adjustably mounted to said rotatable head and said knives and said limiting surface are mounted on a common base member wherein an adjustment of said position of said limiting surface simultaneously adjusts a position of said knives.

51. A wood processing device as claimed in claim 50 wherein each of said knives forms a knife relief angle with respect to said wood being processed and said adjustment of said limiting surface is limited to a range wherein said knife relief angle is suitable for wood processing.

52. A wood processing device as claimed in claim 50 wherein said base member is mounted on a hub having an axis of rotation, and said adjustor translates said base member on said hub to adjust a position of said limit surface relative to said axis of rotation.

53. A wood processing device as claimed in claim 52 wherein said adjustor translates said base member on said hub in a direction transverse to said axis of rotation.

54. A wood processing device as claimed in claim 2 wherein said limiting surface is releasably attached to said head within a range of positions.

55. A wood processing device as claimed in claim 54 wherein said limiting surface is slidably attached to said head within a range of positions.

56. A wood processing device as claimed in claim 5 wherein said base member is pivotally mounted on a hub having an axis of rotation and said adjustor pivots said base member about said pivotal mounting.

57. A wood processing device as claimed in claim 1 wherein said limiting surface is pivotally-mounted to said head.

58. A wood processing device as claimed in claim 2 wherein said limiting surface is mounted on a base member separate from said knives and adjustment of said position of said limiting surface is independent from a position of said knives.

59. A wood processing device as claimed in claim 58 wherein said base member is mounted on a hub having an axis of rotation, and said adjustor translates said base member on said hub to adjust a position of said limit surface relative to said axis of rotation.

60. A wood processing device as claimed in claim 59 wherein said adjustor translates said base member on said hub in a direction transverse to said axis of rotation.

61. A wood processing device as claimed in claim 50 wherein said base member is pivotally mounted on a hub having an axis of rotation and said adjustor pivots said base member about said pivotal mounting.

62. A wood processing device as claimed in claim 61 wherein said pivotal mounting has a pivot axis that is generally parallel to said axis of rotation of said hub.

63. A wood processing device as claimed in claim 58 wherein said base member is pivotally mounted on a hub having an axis of rotation and said adjustor pivots said base member about said pivotal mounting.

64. A wood processing device as claimed in claim 63 wherein said pivotal mounting has a pivot axis that is generally parallel to said axis of rotation of said hub.

65. A wood processing device as claimed in claim 56 wherein said pivotal mounting has a pivot axis that is generally parallel to said axis of rotation of said hub.

* * * * *